US006834653B2

(12) United States Patent
Pluckhahn et al.

(10) Patent No.: US 6,834,653 B2
(45) Date of Patent: Dec. 28, 2004

(54) APPARATUS FOR EXPANDING TOBACCO

(75) Inventors: Frank Pluckhahn, Bayreuth (DE); Gerald Schmekel, Elmshorn (DE); Arno Weiss, Norderstedt (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 0 days.

(21) Appl. No.: 10/160,913

(22) Filed: Jun. 3, 2002

(65) Prior Publication Data

US 2002/0189624 A1 Dec. 19, 2002

Related U.S. Application Data

(62) Division of application No. 09/517,397, filed on Mar. 2, 2000, now Pat. No. 6,397,851.

(30) Foreign Application Priority Data

Mar. 3, 1999 (DE) ..... 199 09 318

(51) Int. Cl.[7] ..... A24B 3/18

(52) U.S. Cl. ..... 131/296; 131/291; 131/300; 131/302; 131/304; 131/290

(58) Field of Search ..... 131/291, 296, 131/300, 302, 304, 290; 426/445, 447; 99/323.4, 323.8; 406/144, 130, 195

(56) References Cited

U.S. PATENT DOCUMENTS 4,248,253 A * 2/1981 Cogbill, II ..... 131/146
4,377,173 A * 3/1983 Rothchild ..... 131/291
4,407,306 A 10/1983 Hibbitts
4,418,706 A 12/1983 Kim et al.
4,513,758 A 4/1985 Henzelin et al.
4,523,598 A 6/1985 Weiss et al.
4,528,995 A * 7/1985 Korte et al. ..... 131/304
5,307,822 A * 5/1994 Egri ..... 131/296
5,365,950 A * 11/1994 Yoshimoto et al. ..... 131/291

FOREIGN PATENT DOCUMENTS

DE 3147846 A1 6/1983
DE 3315274 A1 11/1983
JP 7-294371 * 11/1995

OTHER PUBLICATIONS

Robert Perry, Perry's Chemical Engineers' Handbook 6th. Edition, 5–30, 5–32. 1984.

* cited by examiner

*Primary Examiner*—Dionne A. Walls
(74) *Attorney, Agent, or Firm*—John F. Salazar; Middleton Reutlinger

(57) ABSTRACT

The invention concerns a method and an apparatus for expanding foodstuffs and luxury foodstuffs/tobacco materials capable of being expanded, in particular moist tobacco materials, wherein said materials in a carrier flow comprising steam pass through an expansion zone, comprising a Laval nozzle, in which the speed of sound is attained in the narrowest cross section.

18 Claims, 6 Drawing Sheets

| | | |
|---|---|---|
| $w^1$ | = | velocity gas (steam) inlet nozzle |
| $w^2$ | = | velocity gas (steam) outlet nozzle |
| $w_e$ | = | velocity gas (steam) narrowest cross section nozzle |
| $w_s$ | = | speed of sound gas (steam) |
| p | = | universal pressure |
| w | = | universal velocity |

APPARATUS FOR EXPANDING TOBACCO

CROSS-REFERENCE TO PRIOR APPLICATIONS

This application is a divisional patent application, claiming priority to U.S. patent application Ser. No. 09/517,397, filed on Mar. 2, 2000 now U.S. Pat. No. 6,397,851, which claims priority German Patent Application Serial Number DE 199 09 318.0, filed on Mar. 3, 1999.

BACKGROUND OF THE INVENTION

1. Field of the Invention

The invention relates to a method and apparatus for expanding foodstuffs and luxury foodstuffs/tobacco materials. In particular, the method and apparatus in accordance with the invention may serve to increase the filling capacity of tobacco material or smoking materials reduced in size.

Concerning tobacco material, what should be understood as being included under the term tobacco material or smoking materials reduced in size are threshed tobacco leaves, tobacco stems, tobacco stalks, each cut or shredded, reprocessed tobacco as well as by-products of tobacco such as winnowings in tobacco processing (primary) and in cigarette production and packaging (secondary).

2. Description of Prior Art

Freshly harvested green leaves of tobacco contain a relatively high proportion of water, the residual content of which is reduced by means of various curing methods to less than 10% by mass. The water content is defined as the loss in mass of the tobacco relative to a moisture weigh-in in % by mass in a drying cabinet in a drying time of 3 hours at 80° C. (so-called Salvis moisture). Tobacco prepared as such constitutes raw materials, termed raw tobacco, employed in making e.g. cigarettes or other tobacco-based luxury foodstuffs. The processing chain involved from green leaf up to raw tobacco results in heavy shrinkage, this reduction in volume has a disadvantageous effect on the so-called filling capacity.

The tobacco industry describes filling capacity as the ability to produce finished products (e.g. cigarettes) using as little mass as possible, yet, which are physically stable, firm or hard. (filling capacity also is defined as the remaining volume relative to the weigh-in in ml/g which is derived from compression with a 3 kg weight in a cylindrical vessel after time available of 30 seconds).

Physical and chemical procedural principles are known technically for reversing the shrinking process:

The physical procedures (gaseous change in phase by heat supply) differ substantially by the impregnation means/expanding agent and thus by the change in phase, examples of which are impregnation with $CO_2$ (solid to gaseous change in phase), impregnation with liquid gas (liquid to gaseous change in phase) as well as impregnation with high-pressure $N_2$ (dissolved to gaseous change in phase).

Also to be mentioned in this respect are the methods proposed with organic solvents in liquid form and expulsion as gas, this describing substantially all known low-boiling methods.

The variants of the chemical procedures (generating a gas by thermal decomposition or exothermic reaction) differ substantially by the way the gas reacts in being generated, such as decomposing additives by introducing heat in the dryer or by the addition of further additives to trigger a reaction. Examples of this are impregnating with $NH_3/CO_2$ (solid to gaseous thermal decomposition) with $H_2O_2$ (liquid to gaseous thermal decomposition) and with $N_2H_4/H_2O_2$ (liquid to gaseous exothermic reaction).

Only the physical methods have succeeded in gaining cost-effective significance, typical of which is pressurized impregnation. Subsequent expansion in the dryer is done after the so-called fixing instigated by reducing the pressure/cooling to atmospheric pressure in the impregnator to thus create an equilibrium substance at atmospheric pressure. The significance of these processes is explained by expansion being free of residues, low-cost expanding agents and an increase in volume in the order of magnitude around factor 2.

The drawback with these methods is the need to infeed extra additives and the necessity of a pressurized stage in the tobacco treatment process, impregnation normally being a complicated batch process.

The chemical procedures have gained no significance whatsoever due to the residue problems involved. In all known methods, the tobacco is impregnated either at or above atmospheric pressure with substances which, in a second step, e.g. in a dryer, are quickly put through a change in phase from solid or liquid state into a gaseous phase. This bloating effect results in the increase in volume of the tobacco structures. Known from DE 31 47 846 C2 is a method of enhancing the filling capacity in which the tobacco material is introduced into a carrier flow in a venturi nozzle, it thereby expanding. The drawback in this arrangement in the need to optimize the increase in filling capacity.

As regards the expansion of other foodstuffs and luxury foodstuffs/tobacco materials/tobacco materials capable of expansion (e.g. cereals or pulses; "puffs"), prior art mostly describes discontinuous methods and apparatuses; the following prior publications to be cited in this respect:

DE 195 21 243 describes a method and apparatus, wherein in batch operation a closed vessel is pressurized and the material contained therein heated. The upper portion containing no material is briefly exposed to increased pressure. By the vessel being abruptly opened, the material is output into an expansion chamber at atmospheric pressure. The increased pressure acts as an expansion agent, resulting in the water contained in the material being evaporated and causing said material to expand.

DE 195 21168 describes an apparatus and method analogous to those of DE 195 21 243 except that, in this case, the inner vessel features no holes in the upper portion containing no material.

DE 195 21167 describes an apparatus similar to that of DE 195 21 243 and DE 195 21 168, except that, in this case, the expansion chamber is rotatable and the expanded material is discharged longitudinally by rotation of the drum.

DE 198 06 951 describes an apparatus and a method for buffing a granular material, more particularly a preheat chamber for the material to be expanded. The heater employed comprises a fluidized bed chamber, in which the material is heated batchwise. With the aid of a branch circuit, the product is transferred to the buffing reactor.

Described in DE 198 06 950 is an expansion chamber configured two-part. The first part begins directly at the discharge of the expansion chamber and has the configuration of an elongated slim cone, designed to result in a laminar flow. It ports into the second part in which normal pressure is attained at the latest. Here the flow is turbulent.

Also in the case of this prior art, expansion can still not optimally occur and the systems operating in discontinuous batch operation are complicated and not very effective.

SUMMARY OF THE INVENTION

The object of the present invention is to overcome the aforementioned disadvantages of prior art, the intention being more particularly to effectively make optimum expansion possible and, as regards the tobacco material, it is intended that the cited reduction in the filling capacity/shrinkage is to be counteracted as much as possible.

This object is achieved in accordance with the invention by the subject matter of the independent claims. Preferred embodiments of the invention read from the sub-claims.

The invention makes it possible to attain, in the field of tobacco processing, increases in the filling capacity, not achievable up until now, and which, after expansion, are as much as 10 percent above the values for usual methods of expansion hitherto generally deemed optimized. The positive effects on the cost-effectiveness in producing smoking products are enormous in view of the amounts of tobacco material used in the industry. Corresponding benefits materialize in the area of other expandable foodstuffs and luxury foodstuffs/tobacco materials.

In the method in accordance with the invention the material continuously passes through a zone of elevated pressure, followed by a zone of reduced pressure before ending up in a zone of atmospheric pressure.

The core principle of the method exploits the ability of gases and vapors to totally convert compression energy by means of a nozzle into kinetic energy (in the extreme case, reducing pressure down to 0 bar). This extreme reduction in pressure can only be achieved when at the narrowest location of the nozzle the speed of sound or equivalently the critical pressure ratio is attained. Under these conditions, a further reduction in pressure and thus increase in velocity occurs in the wider section of the nozzle.

Under the same conditions in classic operation of such a nozzle an increase in pressure and thus reduction in volume occurs in the wider section, as is evident from the enclosed FIG. 6 showing, in the upper illustration, a basic nozzle construction, the velocity and pressure profiles for various modes of operation being illustrated below. In this arrangement, the profile identified by the encircled 1 applies to a nozzle in critical closing operation, while the profiles identified by the encircled 2 are for a Laval nozzle in critical operation (at supersonic speed) as used in the present invention.

When a carrier flow (for example saturated steam) is charged e.g. with tobacco material prior to it entering the nozzle, then depending on the input conditions the particles are equilibrated to the temperature and pressure of steam (e.g. 4 bar, 143° C.). Once the two-phase mixture has entered the vacuum zone of the Laval nozzle (e.g. 0.2 bar) the moist particles lose their equilibrium at an elevated temperature (boiling point of water at 0.2 bar: 60° C.) and tobacco moisture evaporates for cooling. This forced evaporation is fed from the internal particle energy. Any transfer of heat from the surroundings is impossible due to the temperature conditions (vapor colder than particles) in the vacuum zone. However, heat is transported outside from inside by the conduction of heat in the particles. Dehumidification/drying in this way is basically different to the so-called convection air-flow dryer, in which the energy required for evaporation is transferred from the gas to the particles.

Due to the very low pressure at the exit of the Laval nozzle, the increases in the filling capacity can be advantageously achieved. In addition to this, the invention makes a continual process possible which can be integrated e.g. in a tobacco preparation process without any special steps being needed (it permitting more particularly integration in an air-flow dryer without first needing to outfeed the tobacco). Thus, this arrangement involves only a minor additional apparatus; additional steps in preparing the tobacco such as casing or flavoring can be directly integrated.

The carrier flow may comprise a steam content of 10 to 100% saturated steam and, more particularly, comprises superheated steam.

In one embodiment of the invention, the pressure of the carrier flow upstream of the Laval nozzle is in the range of less than 1 bar to approx. 30 bar, preferably 1 bar to 30 bar and more particularly 1 bar to 10 bar, and the temperature of the carrier flow upstream of the Laval nozzle is in the range of 50° C. to 450° C., preferably in a range of 100° C. to 300° C.

The pressure at the output of the Laval nozzle may be in the range of 0 to 2 bar, preferably 0.2 to 1 bar.

Described more particularly in the following are embodiments for expanding tobacco material. However, these embodiments are just as suitable for expanding is other foodstuffs and luxury foodstuffs/tobacco materials, including processing solid, fibrous, grainy, bean or leafy foodstuffs and luxury foodstuffs/tobacco materials, e.g. grains, pulses, cereals, barley, maize, beans, wheat, rice or peas. The components of the apparatus, such as separators, are then to be adapted to the material to be processed in each case.

Preferably, the carrier flow is superheated prior to the material/tobacco material being incorporated.

In one preferred embodiment of the method in accordance with the invention, the carrier flow passes through an infeed zone, a nozzle antechamber, the Laval nozzle, an infeed diffusor and an outfeed diffusor.

On the one hand, the tobacco material may be fed into the carrier flow in the infeed zone upstream of the Laval nozzle, preferably via a rotary vane lock comprising a header placed onto the infeed zone.

On the other hand, it is possible to feed the tobacco material into the carrier flow at the Laval nozzle in the zone of lowest pressure, preferably via a rotary vane lock comprising a header placed onto the Laval nozzle.

As far as further processing of the tobacco material is concerned it is possible in accordance with the invention to supply the tobacco material, after it having passed through the outfeed diffusor, to a tobacco separator, more particularly a centrifugal separator, the vacuum of which is maintained preferably by a vacuum compressor. However, after it having passed through the outfeed diffusor, the tobacco material may also be first supplied to an air-flow dryer and then to a tobacco separator, more particularly a centrifugal separator.

In one advantageous embodiment of the method in accordance with the invention, the gas flow passing the components adjoining the outfeed diffusor is collected by means of an air recycling system, compressed and recycled as part of the carrier flow.

The apparatus in accordance with the invention is preferably characterized by it comprising a means, more particularly a heat exchanger, for superheating the carrier flow prior to the tobacco material being incorporated.

In one development of the apparatus in accordance with the invention, the flow guidance means comprise an infeed zone, a nozzle antechamber, the Laval nozzle, an infeed diffusor and an outfeed diffusor.

A rotary vane lock having a header placed onto the infeed zone may be provided, by means of which the tobacco material is fed into the carrier flow in the infeed zone upstream of the Laval nozzle.

Furthermore, the apparatus may comprise a rotary vane lock having a header is placed onto the Laval nozzle, by means of which the tobacco material is supplied to the carrier flow at the Laval nozzle in the zone of lowest pressure.

Preferably, the apparatus comprises a tobacco separator, more particularly a centrifugal separator to which the tobacco material is supplied after having passed through the outfeed diffusor, and the vacuum of which is maintained preferably by means of a vacuum compressor.

In another embodiment, the apparatus comprises an air flow dryer and adjoining thereto a tobacco separator, more particularly a centrifugal separator, to which the tobacco material is supplied after having passed through the outfeed diffusor.

It is particularly advantageous to provide an air recycling system by means of which the gas flow passing the components adjoining the outfeed diffusor is collected, compressed and re-supplied to the carrier flow.

BRIEF DESCRIPTION OF THE DRAWINGS

The invention will now be detailed by describing example embodiments with reference to the attached drawings in which.

DETAILED DESCRIPTION OF THE PREFERRED EMOBIDMENTS

Figure 1:
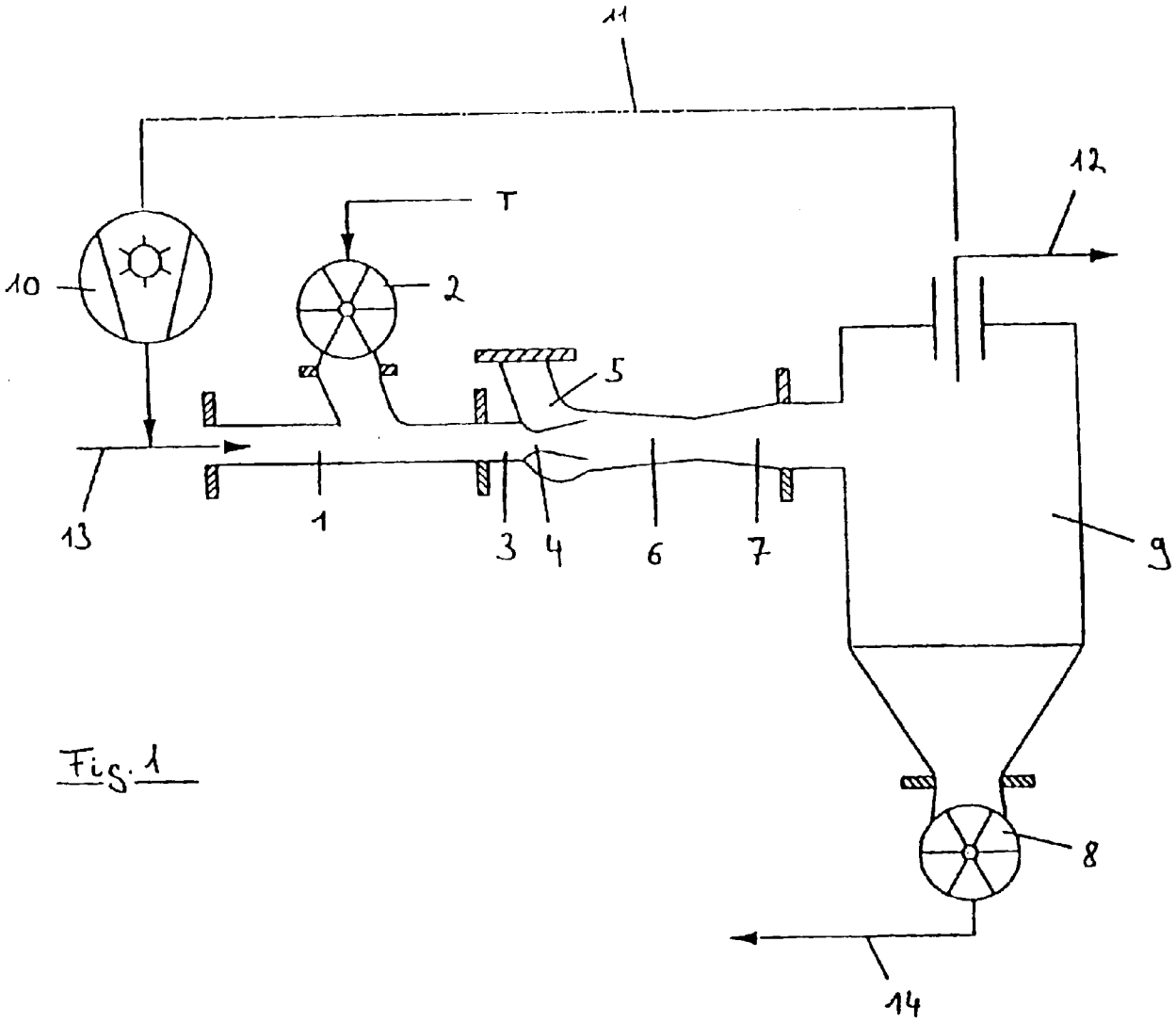
FIG. 1 is a schematic illustration of an apparatus of the present invention for expanding tobacco material including an adjoining cyclone separator in accordance with a first embodiment of the invention.

In the FIGS. 1 to 4, reference numeral 1 identifies an infeed zone, 2 a rotary vane lock, 3 a nozzle antechamber, 4 a Laval nozzle (also termed expansion nozzle), 5 a header on the Laval nozzle, 6 an infeed diffusor, 7 an outfeed diffusor, 8 a discharge lock, 9 a cyclone separator, 10 a compressor, 11 an air recycling system, 12 an exhaust air system, 13 a carrier flow, 14 a tobacco discharge from the cyclone separator, 15 a drying tower, 16 an optional casing/flavor feed, 17 a feed air supply to the drying tower and 18 the discharge from the drying tower. T denotes tobacco material. Like reference numerals identify like components.

Figure 2:
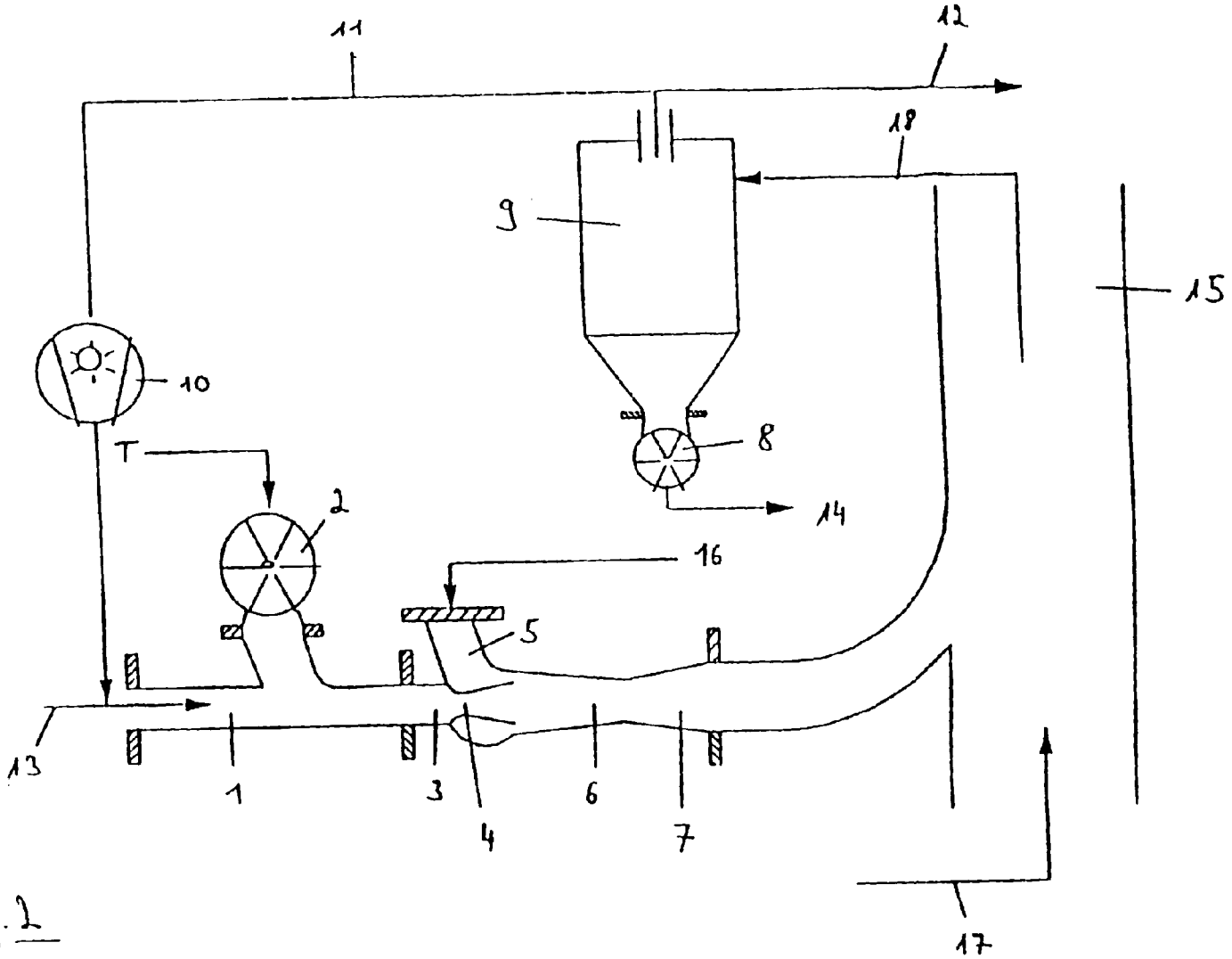
FIG. 2 is a schematic illustration of an apparatus of the present invention for expanding tobacco material including an adjoining drying tower in accordance with a second embodiment of the invention.

FIGS. 1 and 2 illustrate those embodiments of the invention in which the tobacco material is fed to the carrier flow 13 in the infeed zone, i.e. at the pressure side of the Laval nozzle.

Referring now to FIG. 1, there is illustrated an embodiment including direct separation in the tobacco separator 9 downstream of the nozzle 4. The tobacco is transported by a sluice into the infeed zone 1, preferably by a rotary vane lock 2 suitable for high differential and absolute pressures. In the infeed zone, the tobacco is mixed with the carrier flow 13, preheated and moisturized using steam. The mass flow ratio of carrier flow to tobacco material may be set simply by selecting the narrowest cross section in the Laval nozzle 4 (expansion nozzle) for a given mass flow of the tobacco material. For example, at a saturated steam pre-pressure of 2 bar (approx. 120° C.) a maximal mass flow of 400 kg/h is achieved for a nozzle diameter of 21.8 mm; whereas for a nozzle diameter of 15.4 mm a maximal thruput of 200 kg/h is attained. A good useful ratio is in the range of 0.1 to 10 kg carrier flow per kg tobacco material. Downstream of the nozzle antechamber 3 and the nozzle 4, following the adiabatic relaxation, a lower pressure, and thus a corresponding lower temperature of the carrier flow, occurs depending on the nature of the carrier flow, design of the apparatus and method profile. The tobacco material attempts to counteract the temperature imbalance by evaporation and removal of the internal energy induced in the tobacco material by the charging in the input zone. Preferably, pressures of less than 1 bar are set at the output of the Laval nozzle 4. Depending on the desired process pressure in the tobacco separator 9, the steam needs to be correspondingly compressed with the aid of the infeed/outfeed diffusor 6/7.

This variant of the method as shown in FIG. 1 is preferably indicated in the tobacco drying methods subsequent to expansion which do not use the carrier flow 13 as the drying or transport medium, these being e.g. drum, vibro/fluidized bed or belt drying methods. These drying methods necessitate prior separation of the tobacco material and carrier flow, done by means of a tobacco separator, preferably a centrifugal separator 9 such as e.g. a cyclone or tangential separator. When wishing to exploit the benefits of a vacuum expansion with no subsequent compression to atmospheric pressure, the tobacco material would need to be likewise separated from the carrier flow with drum, vibro/fluidized bed or belt drying methods, discharge 14 of the tobacco then occurring from the vacuum zone into the atmospheric pressure zone. The vacuum in the tobacco separator 9 may be maintained for example by a vacuum pump (not shown). In the embodiment illustrated in FIG. 2, separation of the tobacco material occurs after it has passed through an air flow dryer, in this case a drying tower 15.

After it has passed through the diffusor 6/7, the tobacco is directly transported into the drying tower 15, with no separation of the carrier flow 13, and after having been moistened via the tobacco separator 9, preferably a centrifugal separator, such as e.g. a cyclone or tangential separator, it is discharged by means of a discharge lock 8 (arrow 14). For this purpose, it is necessary to adapt the velocity and pressure of the carrier flow 13 to the conditions in the drying tower 15. Preferably, in this case, an expansion mode is selected in which the pressure in the outfeed diffusor 7 is in the range of 0.9 to 1.1 bar.

Common to both variants as shown in FIGS. 1 and 2 is the option of recycling the air fully or in part by means of the air recycling system 11 for reusing the carrier flow 13, preferably with air as the carrier flow 13 which in view of economics can be considered as a particularly cost-effective solution.

Optional also to both variants is incorporating fluid/solid additives (casing, flavor) in the header portion 5 of the Laval nozzle 4, as is indicated in FIG. 2 by the reference numeral 16.

Figure 3:
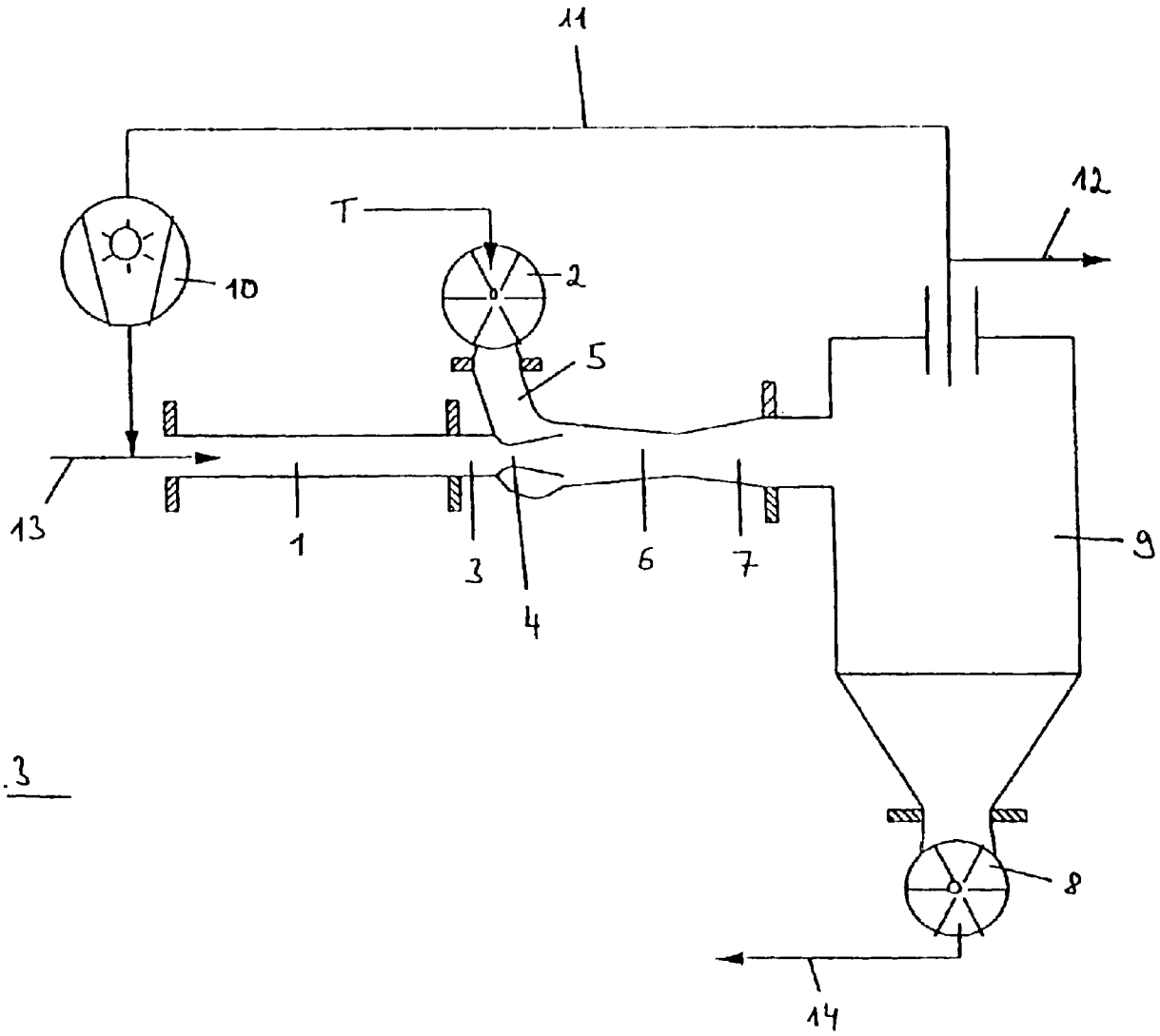
FIG. 3 is a schematic illustration of an apparatus of the present invention for expanding tobacco material including an adjoining cyclone separator and a tobacco material feed to a Laval nozzle in accordance with a third embodiment of the invention.
Figure 4:
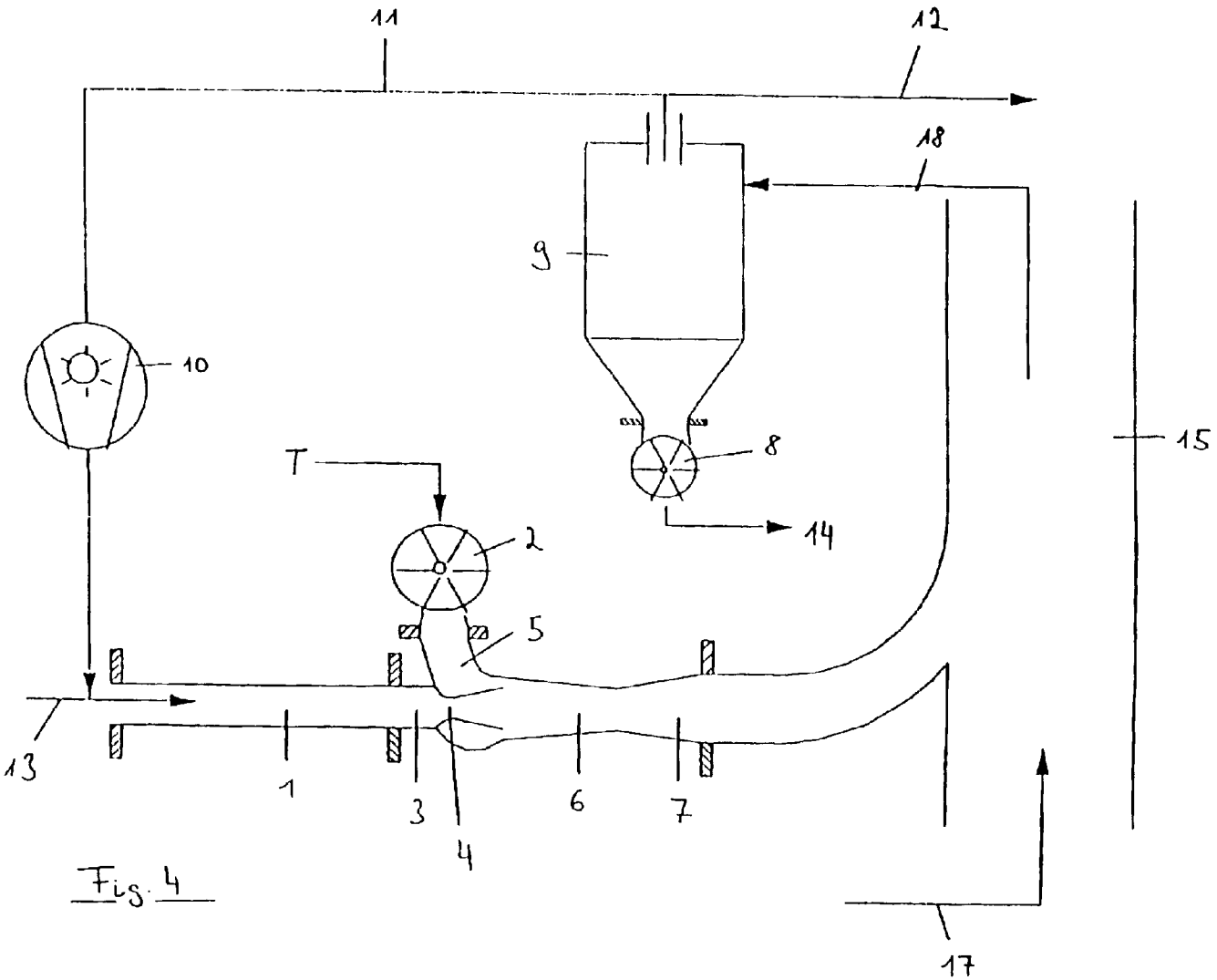
FIG. 4 is a schematic illustration of an apparatus of the present invention for expanding tobacco material including an adjoining drying tower and a tobacco material feed to a Laval nozzle in accordance with a fourth embodiment of the invention.

FIGS. 3 and 4 shows variants in accordance with the invention in which the tobacco material is fed to the suction side of the nozzle 4.

FIG. 3 illustrated a variant in which separation is done directly in the tobacco separator 9 downstream of the nozzle/diffusor 4, 6/7. In this arrangement, mixing the tobacco material with the carrier flow is thus achieved by bringing the tobacco material into the header zone 5 of the Laval nozzle 4, i.e. introducing the tobacco material directly via a rotary vane lock 2 into the zone of lowest pressure (0–1 bar) at the outfeed of the nozzle 4. This has the advantage that the difference in pressure to that of the surroundings at the tobacco material infeed is less than 1 bar and the temperature of the carrier flow at this location is significantly lower (<150° C.), as a result of which the feeder 2 is exposed to less stress by high temperatures, while being "resistant to differential pressure" (minimum air leakage).

The apparatus (nozzle 4, infeed diffusor 6) and the pre-pressure upstream of the nozzle 4 should be configured for this variant of the method so that the lowest achievable pressure materializes at the outfeed of the nozzle 4, to thus enable the increase in pressure materializing from leakage air entering via the feeder 2, to be compensated.

In this variant of the method, the tobacco material should be preheated to a temperature exceeding 90° C. (e.g. by a steam tunnel) prior to it entering the nozzle 4, so that the tobacco material in the vacuum zone of the nozzle 4 (<1 bar) is abruptly exposed to the zone of thermodynamic imbalance, as described above, and water evaporates for cooling. As already described, the steam is correspondingly condensed with the aid of the outfeed diffusor 7 depending on the desired process pressure in the tobacco separator 9.

This variant of the method is likewise preferably characterized by the tobacco drying methods following expansion which do not utilize the carrier flow 13 as the drying or transport medium, these being e.g. drum, vibro/fluidized bed or belt drying methods. These drying methods necessitate prior separation of the tobacco material and carrier flow, done by means of a tobacco separator 9, preferably a centrifugal separator such as e.g. a cyclone or tangential separator.

When exploiting the benefits of a vacuum expansion with no subsequent compression to atmospheric pressure, the tobacco material would need to be likewise separated from the carrier flow according to drum, vibro/fluidized bed or belt drying methods, discharge 14 of the tobacco then occurring from the vacuum zone into the atmospheric pressure zone.

FIG. 4 illustrates again an embodiment including separation downstream of the air flow dryer. In this variant—as already described with reference to FIG. 3—the tobacco material is placed in the header zone in the apparatus. Here again, the method as further described with reference to FIG. 3 finds application (except for separation in the separator directly following the expansion nozzle), i.e. the difference being in the combination of incorporating the tobacco material at the suction side of the nozzle with separation of the tobacco after it has passed through an air dryer.

In this arrangement, the tobacco material is again transported directly, without separation of the carrier flow after passing through the diffusor 6/7, into the drying tower 15 and, after dehumidification/drying via a tobacco separator 9, preferably a centrifugal separator, such as e.g. a cyclone or tangential separator it is discharged (arrow 14). For this purpose, it is necessary, in this case too, to adapt the velocity and pressure of the carrier flow to the conditions in the drying tower 15.

Preferably, also in this case, an expansion mode is selected in which the pressure in the outfeed diffusor 7 is in the range of 0.9 to 1.1 bar.

Common to both variants (FIGS. 3 and 4) is once again the option of recycling the air fully or in part by means of the air recycling system (reference numeral 11) for reusing the carrier flow, preferably with air as the carrier flow.

Figure 5:
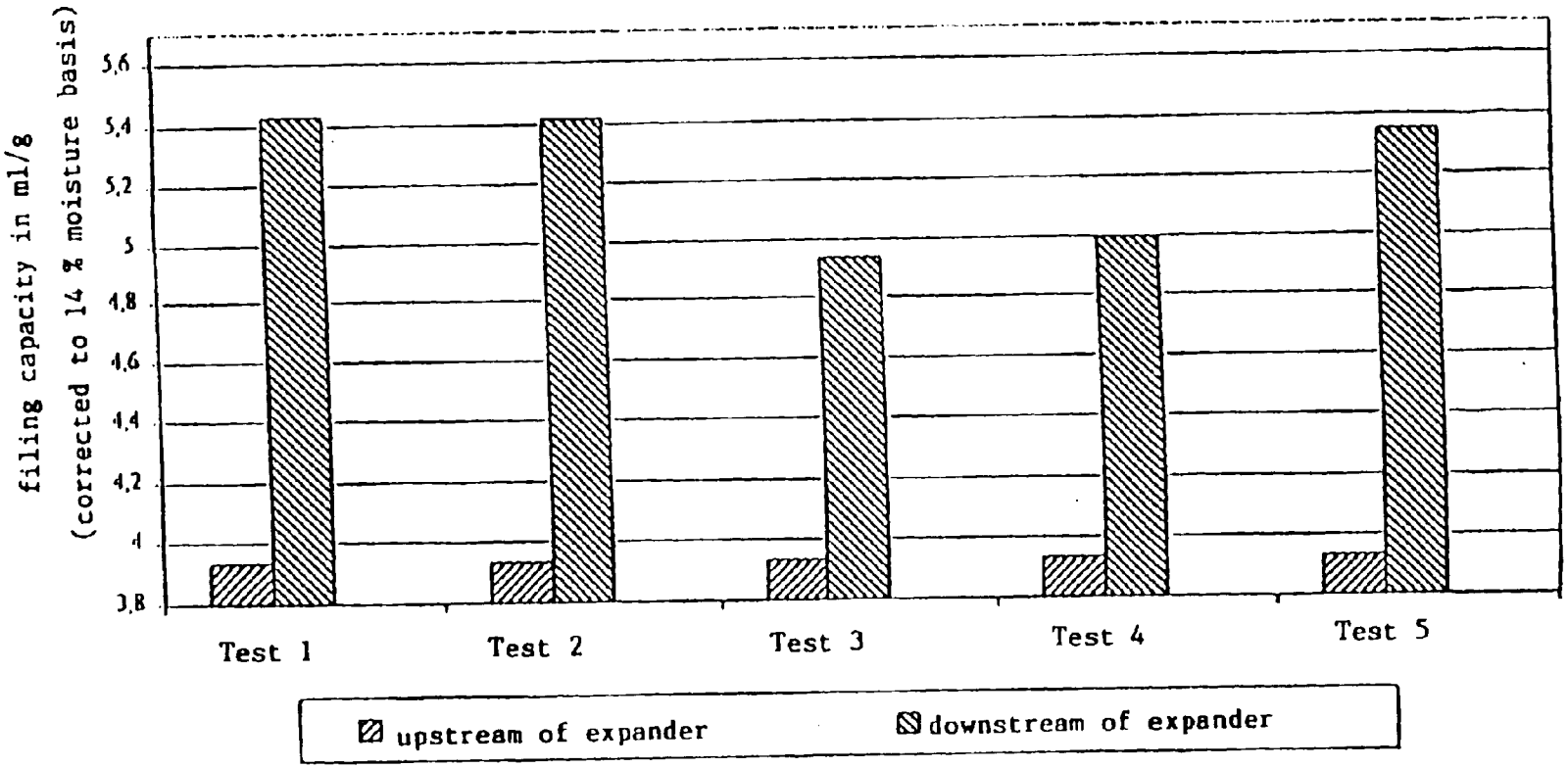
FIG. 5 is a bar chart comparing the increase in the filling capacity by the methods in accordance with the invention to comparable prior art methods.
Figure 6:
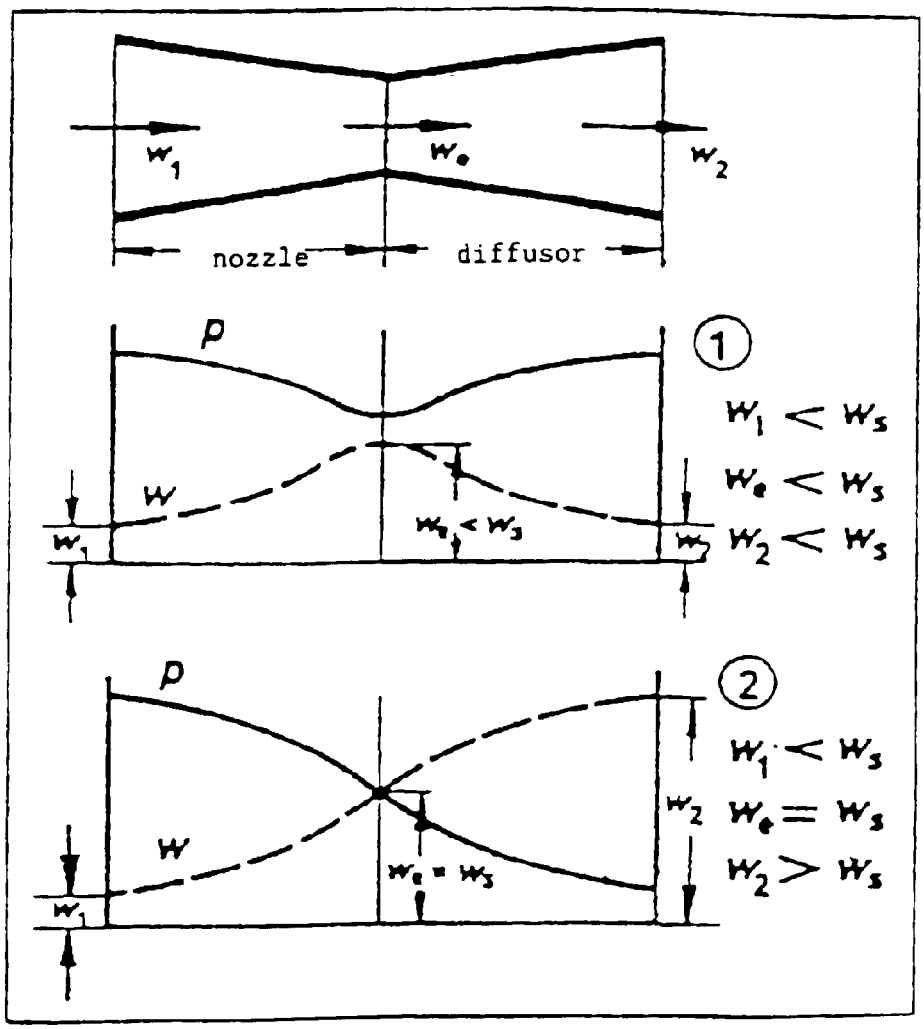
FIG. 6 is a schematic illustration of a nozzle cross-section for the present invention indicating the pressure and velocity profiles for critical and sub-critical operation.

FIG. 5 shows a bar chart comparing the increase in the filling capacity by the methods in accordance with the invention to comparable prior art methods. The test parameters are listed in the following:

| Test 1 (Laval nozzle): | |
|---|---|
| Tobacco material | standard stem blend |
| Apparatus Config. | see FIG. 1 (no compressor 10, no air recycling, no optional casing/flavor) |
| Nozzle Diameter | 15 mm |
| Carrier flow | saturated steam |
| Parameters | 2.2 bar pre-pressure (Pos. 3), pressure in nozzle 0.6 bar (Pos. 6), steam temperature approx. 123° C. in Pos. 3, steam temperature in cyclone (Pos. 9) approx. 100° C., steam pressure in cyclone (Pos. 9) approx. 1 bar carrier flow mass flow/tobacco mass flow ratio 0.67, tobacco moisture content upstream of expander (upstream of feeder Pos. 2) approx. 40% (moisture basis), tobacco moisture content downstream of expander (downstream of cyclone Pos. 9) approx. 43,5% (moisture basis) |

| Test 2 (Laval nozzle): | |
|---|---|
| Tobacco material | standard stem blend |
| Apparatus Config. | see FIG. 1 (no compressor 10, no air recycling, no optional casing/flavor) |
| Nozzle Diameter | 15 mm |
| Carrier flow | saturated steam |
| Parameters | 2.2 bar pre-pressure (Pos. 3), pressure in nozzle 0.65 bar (Pos. 6), steam temperature approx. 23° C. in Pos. 3, steam temperature in cyclone (Pos. 9) approx. 100° C., steam pressure in cyclone (Pos. 9) approx. 1 bar carrier flow mass flow/tobacco mass flow ratio 0.43, tobacco moisture content upstream of expander (upstream of feeder Pos. 2) approx. 40% (moisture basis), tobacco moisture content downstream of expander (downstream of cyclone Pos. 9) approx. 43% (moisture basis) |

| Test 3 (STS* nozzle): | |
|---|---|
| Tobacco material | standard stem blend |
| Apparatus Config. | conventional STS apparatus |
| Carrier flow | saturated steam |
| Parameters | carrier flow mass flow ratio/tobacco mass flow ratio 0.67, tobacco moisture content upstream of expander approx. 40% (moisture basis), tobacco moisture content downstream of expander approx. 44% (moisture basis), |

*steam treated stems

| Test 4 (STS* nozzle): | |
|---|---|
| Tobacco material | standard stem blend |
| Apparatus Config. | conventional STS apparatus |
| Carrier flow | saturated steam |
| Parameters | carrier flow mass flow/tobacco mass flow ratio 0.47, tobacco moisture content upstream of expander approx. 40.7% (moisture basis), tobacco moisture content downstream of expander approx. 44.3% (moisture basis), |

*steam treated stems

| Test 5 (Laval nozzle): | |
|---|---|
| Tobacco material | standard stem blend |
| Apparatus Config. | see FIG. 1 (no compressor 10, no air recycling, including casing in air intake (Pos. 5), |
| Nozzle Diameter | 15 mm |
| Carrier flow | saturated steam |
| Parameters | 2.2 bar pre-pressure (Pos. 3), pressure in nozzle 0.6 bar (Pos. 6), steam temperature approx. 123° C. in Pos. 3, steam temperature in cyclone (Pos. 9) approx. 100° C., steam pressure in cyclone (Pos. 9) approx. 1 bar carrier flow mass flow/tobacco mass flow ratio 0.67, tobacco moisture content upstream of expander (upstream of feeder Pos. 2) approx. 40% (moisture basis), tobacco moisture content downstream of expander (downstream of cyclone Pos. 9) approx. 46% (moisture basis) |

It is directly evident that the increase in the filling capacity and the absolute values attained in tests 1, 2 and 5, which employ a method in accordance with the invention, are substantially greater than those of the STS methods, viewed hitherto as being optimized, the results of which are represented by the bar plot pertinent to the tests 3 and 4. In accordance with the invention, the resulting filling capacities are approx. 10% greater. The positive effects on the cost-effectiveness in producing smoking products are enormous in view of the amount of tobacco material used in the industry.

The final table summarizes suitable and preferable parameter values for is implementing the method in accordance with the invention:

| Parameter | Overall range | Preferred range |
|---|---|---|
| Carrier flow pressure upstream of nozzle | 1–30 bar | 1–10 bar |
| Carrier flow temperature upstream of nozzle | 50–450° C.[1] | 100–250° C.[1] |
| Carrier flow pressure in nozzle | >0–2 bar | 0.2–1.0 bar |
| Carrier flow pressure in outfeed diffusor (Pos. 7) | >0–2 bar | 0.2–1.1 bar |
| Tobacco moisture content upstream of infeed rotary vane lock | 10–60% (moisture basis) | 17–45% (moisture basis) |
| Tobacco temperature upstream of infeed rotary vane lock | 10–100° C. | 20–95° C. |
| ratio of carrier flow mass flow/tobacco mass flow | 0.1–10 (kg/h)/(kg/h) | 0.2–1 (kg/h)/(kg/h) |
| Carrier flow steam content | 10–100% (mass % moisture basis) | 50–100% (mass % moisture basis) |

-continued

| Parameter | Overall range | Preferred range |
|---|---|---|

[1]with additional superheating of carrier flow by a heat exchanger upstream of the infeed rotary vane lock ("superheated steam")

All pressure indications are absolute values.

Tests were also carried out on the expansion of other foodstuffs and luxury foodstuffs/tobacco materials/tobacco materials, these too achieving good expansion results. Especially, barley and maize proved to be suitable for expansion in accordance with the invention, producing puffed forms. The test configuration in this respect was basically the same as that of test 1, described above, as regards configuration and carrier flow of the apparatus.

What is claimed is:

1. An expansion apparatus for expanding tobacco, comprising:

an infeed zone, a nozzle antechamber, a nozzle having a converging section, a narrowest cross section and a diverging section, an infeed diffuser and an outfeed diffuser;

a header within said nozzle in flow communication with a rotary vane lock;

a compressor in fluid communication with said nozzle antechamber;

means to provide a carrier flow having steam within said nozzle, said carrier flow provided such that said flow has a velocity equal to or greater than the speed of sound at said narrowest cross section point of said nozzle;

a separator in flow communication with said outfeed diffuser.

2. The apparatus as set forth in claim 1, characterized in that said apparatus comprises a rotary vane lock including a header, placed onto said infeed zone, by means of which said tobacco materials is fed into said carrier flow in said infeed zone upstream of said nozzle.

3. The apparatus as set forth in claim 1 characterized in that said apparatus comprises a rotary vane lock having a header placed onto said nozzle, by means of which said tobacco materials are supplied to said carrier flow at said nozzle in a zone of lowest pressure.

4. The apparatus as set forth in claim 1 characterized in that said apparatus comprises a separator to which said tobacco materials, after having passed through said outfeed diffuser, are supplied, a vacuum of which is maintained by means of a vacuum pump.

5. The apparatus as set forth in claim 4 characterized in that said apparatus comprises an air recycling system by means of which said gas flow passing the components adjoining said outfeed diffuser is collected, compressed and re-supplied to said carrier flow.

6. The apparatus of claim 4 wherein said separator is a centrifugal separator.

7. The apparatus as set forth in claim 1 characterized in that said apparatus comprises an air flow dryer and adjoining thereto a separator to which said tobacco materials is supplied after it having passed through said outfeed diffuser.

8. The apparatus of claim 7 wherein said separator is a centrifugal separator.

9. An apparatus for expanding tobacco materials comprising:

a flow guidance mechanism having an infeed zone, a compressor being in fluid communication with a nozzle antechamber in which said tobacco materials in a carrier flow comprising steam, pass through an expansion zone, characterized in that said flow guidance mechanism has a nozzle having a converging section, a narrowest cross section and a diverging section which operates such that the speed of sound is attained in its narrowest cross section, as well as an infeed zone, a nozzle antechamber, an infeed diffuser and an outfeed diffuser.

10. The apparatus as set forth in claim 9, characterized in that said apparatus further comprises a heat exchanger, for superheating said carrier flow prior to said tobacco material being brought in.

11. A nozzle apparatus for expanding tobacco, comprising:

an infeed zone, a nozzle antechamber having a compressor in fluid communication therewith, an expansion nozzle having a converging section, a narrowest cross section and a diverging section, an infeed diffuser and an outfeed diffuser;

a header within said nozzle apparatus in flow communication with a rotary vane lock;

a carrier flow having steam within said nozzle, said carrier flow provided such that said flow has a velocity equal to or greater than the speed of sound at said narrowest cross-section point of said nozzle.

12. The nozzle apparatus of claim 11 wherein said rotary vane lock maintains a carrier flow mass flow to tobacco mass flow in a range between 0.1 kg and 1 kg carrier flow per 1 kg tobacco mass flow.

13. The nozzle apparatus of claim 11 further said nozzle apparatus generates a first predefined pressure in said antechamber and a second predefined pressure in said narrowest cross section, said first pressure being between 2 bar and 8 bar, said second pressure being between 0 bar and 1 bar.

14. The nozzle apparatus of claim 11 further having means to generate a first predefined pressure in said antechamber and a second predefined pressure in said narrowest cross section, said first pressure being between 2 bar and 8 bar, said second pressure being between 0 bar and 1 bar.

15. The nozzle apparatus of claim 11 further comprising an air recycling system and a drying tower in flow communication with said carrier flow.

16. An expansion apparatus for expanding tobacco, comprising:

an infeed zone with a compressor in flow communication, a nozzle antechamber, a nozzle having a converging section, a narrowest cross section, and, a diverging section, an infeed diffuser and an outfeed diffuser;

a header in said nozzle apparatus in flow communication with a rotary vane lock;

means to provide a carrier flow having steam within said nozzle;

means to introduce tobacco material into said carrier flow through said rotary vane lock into a zone of lowest pressure created in said nozzle;

a separator in flow communication with said outfeed diffuser.

17. The expansion apparatus of claim 16 wherein said carrier flow is provided with a velocity equal to or greater than the speed of sound at said narrowest cross section point of said nozzle.

18. An expansion apparatus for expanding tobacco, comprising:

an infeed zone, means to increase pressure in said infeed zone, a nozzle antechamber, a nozzle having a converging section, a narrowest cross section, and a diverging section, an infeed diffuser and an outfeed diffuser;

a header in said nozzle apparatus in flow communication with a rotary vane lock;

a steam content carrier flow within said nozzle;

tobacco material provided to said carrier flow through said rotary vane lock into a zone of lowest pressure created in said nozzle; a separator in flow communication with said outfeed diffuser wherein said carrier flow is provided with a velocity equal to or greater than the speed of sound at said narrowest cross section of said nozzle.

* * * * *

UNITED STATES PATENT AND TRADEMARK OFFICE

CERTIFICATE OF CORRECTION

PATENT NO. : 6,834,653 B2
APPLICATION NO. : 10/160913
DATED : December 28, 2004
INVENTOR(S) : Frank Pluckhahn, Gerald Schmekel and Arno Weiss It is certified that error appears in the above-identified patent and that said Letters Patent is hereby corrected as shown below:

Column 4, line 22, “is” should be deleted
Column 5, LN 55 in section header, “embodiments” is spelled incorrectly.
Column 8, Test 3, LN 64 delete the comma at the end of the parameters text
Column 9, Test 4, LN 11 delete the comma at the end of the parameters text
Column 9, Text 5, LN 19 add close parenthesis after intake and delete comma
Column 9, LN 62 chart at bottom of column, capitalize “ratio”
Claim 2, COL 10, LN 36 delete comma after “claim 1”
Claim 10, COL. 11, LN 10 delete comma after “claim 9”
Claim 13, COL. 11, LN 32 change further to wherein Signed and Sealed this Twenty-second Day of August, 2006

JON W. DUDAS
*Director of the United States Patent and Trademark Office*